United States Patent [19]

Hunter

[11] 4,378,783

[45] Apr. 5, 1983

[54] HOT SPOT BUTANE HEATER

[75] Inventor: James B. Hunter, Newton Square, Pa.

[73] Assignee: Johnson Matthey Inc., Malvern, Pa.

[21] Appl. No.: 173,352

[22] Filed: Jul. 29, 1980

[51] Int. Cl.[3] ..... F24B 3/00

[52] U.S. Cl. ..... 126/25 B; 126/85 R; 137/321; 431/329

[58] Field of Search ..... 126/85 R, 91 A, 25 B; 431/329, 328; 137/321, 323

[56] References Cited

U.S. PATENT DOCUMENTS

| | | | |
|---|---|---|---|
| 2,728,509 | 12/1955 | Peterson | 137/321 |
| 2,737,037 | 3/1956 | Zellweger | 67/37 |
| 3,066,514 | 2/1963 | Iketani | 67/7.1 |
| 3,078,010 | 2/1963 | Ichikawa et al. | 222/3 |
| 3,523,005 | 8/1970 | Paffath | 431/344 |
| 3,583,846 | 6/1971 | Kimball | 431/142 |
| 3,814,573 | 6/1974 | Karlovetz | 431/329 |
| 3,815,572 | 6/1974 | Wolfe | 126/85 R |
| 3,876,365 | 4/1975 | Hefling et al. | 431/329 |
| 3,975,140 | 8/1978 | Placek | 431/329 |
| 4,090,034 | 2/1980 | Wonisch | 126/25 B |
| 4,177,646 | 12/1979 | Guadagnin et al. | 431/344 |
| 4,177,790 | 12/1979 | Zenzaburo | 126/38 |

*Primary Examiner*—Daniel J. O'Connor

*Attorney, Agent, or Firm*—Cushman, Darby & Cushman

[57] ABSTRACT

A portable heater, and component parts thereof, is provided that is capable of safely generating large amounts of heat over a relatively long time frame without significant amounts of pollution. A source of combustible gas, such as a canister of liquefied butane, is in operative communication with a combustion chamber through a control valve. The combustion chamber comprises an elongated tubular member concentric with a chimney. Air and combustible gas are drawn into the bottom of the tubular combustion chamber and combust without flame on a plurality of metal heat-resistant screens. A simple relative rotation between top and bottom casing components controls the flow of gas. A removable piezoelectric igniter is mounted on top of the heater to effect ignition.

10 Claims, 5 Drawing Figures

HOT SPOT BUTANE HEATER

BACKGROUND AND SUMMARY OF THE INVENTION

There are many situations in which a portable heater is extremely useful. For instance for outdoor sporting events, such as football games, in cold weather season areas, a portable heater can make the difference between comfort and discomfort and being able to stay until the end of the game or having to leave early. Military personnel in cold weather areas would have their comfort greatly enhanced with a portable heater, especially one capable of heating up food, coffee, etc., on an individual basis. An effective portable heater could greatly enhance comfort, and perhaps even save lives, in emergency situations such as snow storms, power failures, and the like, and for all people involved in outdoor wintertime work or recreational activities.

In order to be effective, a portable heater must be able to generate significant amounts of heat over a relatively long period of time (e.g., 8 to 10 hours), must not be dependent upon stationary, preexisting energy sources, must be safe, and must be able to generate heat without generating significant amounts of pollution.

According to the present invention, a portable heater is provided that is capable of achieving all of the above-enumerated requirements. The portable heater according to the present invention is light in weight, convenient to carry, and provides a safe, comfortable heat source for one or more persons for 8 to 10 hours utilizing a single container of fuel. The heater according to the present invention is capable of burning butane (which may be provided in replaceable liquefied butane canisters) instead of propane for increased safety, weight reduction and ease of canister replacement. Heat is provided without flame for enhanced safety, and there is minimal production of pollutants (e.g., hydrocarbons about 10 ppm or less, carbon monoxides about 1–2 ppm, and nitrogen oxides about 0.1 ppm).

The portable heater according to the present invention includes as one of the important component parts thereof a combustion chamber assembly. The combustion chamber assembly includes an elongated tubular combustion chamber of heat-resistant metal having a first exhaust end, and a second entry end. A second tubular member is mounted interiorly and substantially concentric with the tubular combustion chamber and adjacent the second end thereof. A plurality of screens of heat-resistant metal such as Kanthal are mounted within the combustion chamber in planes substantially perpendicular to the direction of elongation of the combustion chamber, and spaced from the interiormost end of the second tubular member. The second tubular member has a detachable combustible gas feeding portion which extends outwardly past the termination of the combustion chamber second end, and has a plurality of openings formed in the walls thereof for the entry of surrounding air to mix with combustible gas flowing through the second tubular member. A stainless steel honeycomb structure or the like is provided surrounding a portion of the second tubular member within the combustion chamber adjacent the second end of the combustion chamber, the honeycomb structure allowing for the passage of air through the combustion chamber second end around the second tubular member to the screens. The honeycomb structure terminates within the combustion chamber so that an apron is provided by a portion of the tubular combustion chamber past the termination of the honeycomb structure increasing the "chimney action" of the combustion chamber and ensuring that all hydrocarbons pass upwardly and are not bypassed around the heated screens.

The portable heater according to the present invention includes means for receiving a source of combustible gas, a combustion chamber (preferably as described above), and means for providing the transport of combustible gas from the source to the combustion chamber and for the transport of ambient air into the combustion chamber to mix with combustible gas to effect combustion. The screens facilitate combustion without flame (except during initial start-up), and the top of the combustion chamber provides an exhaust conduit to the ambient air for exhausting the products of combustion. A third tubular member having perforations at the second end thereof is provided concentric with the combustion chamber, and is coated over most of the length thereof with a baked-on ceramic. This arrangement provides easy inflow of air and promotes a strong updraft as air rises past the combustion chamber.

A removable piezoelectric element or like ignition means is preferably provided in operative association with the top of the combustion chamber. After ignition, the igniter is removed to allow exhaust of the product of combustion. Ignition can thus be accomplished in a safe, reliable manner without requiring amy extraneous ignition source (such as matches).

The means for receiving a source of combustible gas comprises a hollow bottom casing component including a control valve means mounted therein for receiving a canister of liquefied butane or the like. The control valve provides for reliable, readily controllable metering of combustible gas from the canister to the combustion chamber by a simple relative rotation between upper and lower casing components. The valve includes a neoprene disc having a small diameter hole formed therein. An actuator is moved into and out of compressive engagement with the disc to compress the disc and close off the central opening preventing gas flow, or allow passage of gas through the central opening, respectively. A neoprene washer and metal washer act between the reciprocal hollow tube actuator and the disc.

It is the primary object of the present invention to provide a simple, safe portable heater capable of generating significant amounts of heat over relatively long time periods without requiring a stationary power source, and without significant pollution. This and other objects of the invention will become apparent from an inspection of the detailed description of the invention, and from the appended claims.

BRIEF DESCRIPTION OF THE DRAWINGS

FIG. 4 is a detailed cross-sectional view of the control valve and related components of the heater of FIGS. 1 through 3.

DETAILED DESCRIPTION OF THE DRAWING

Figure 1:
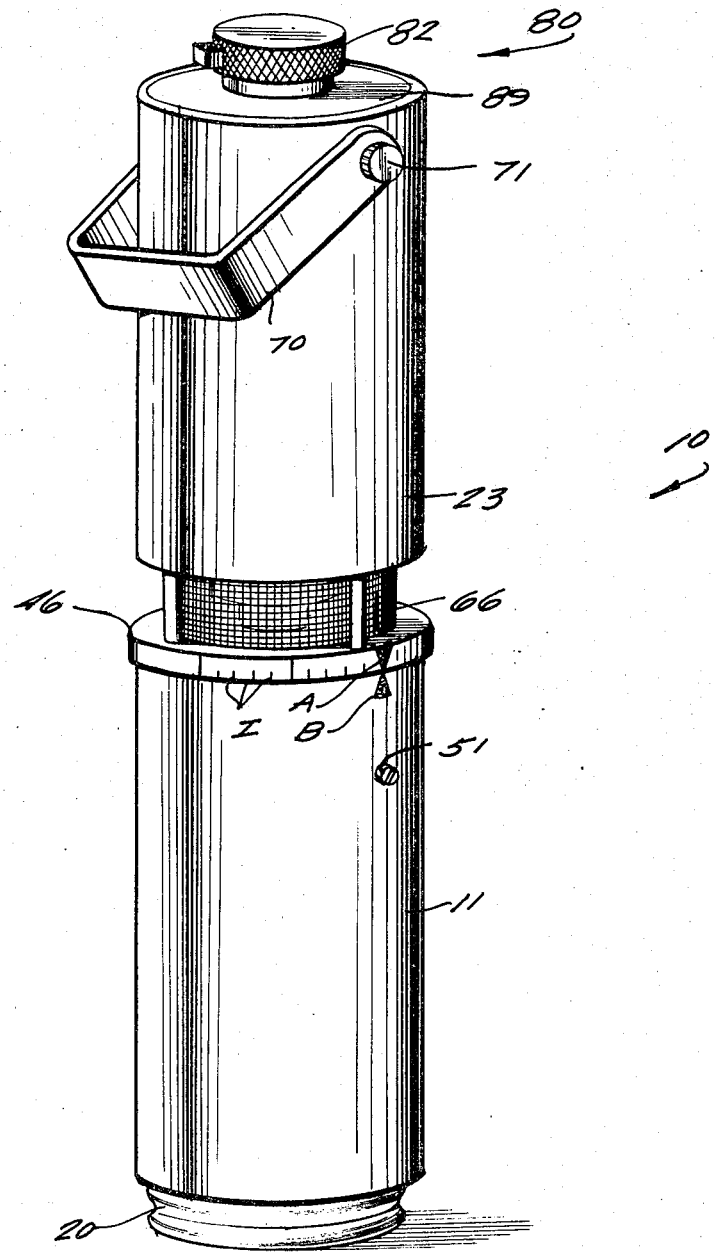
FIG. 1 is a perspective view of an exemplary assembled portable heater according to the present invention.

An exemplary portable heater according to the present invention is shown generally at 10 in the drawings. Basic components of the heater 10 include a means for receiving a source of combustible gas, such as the bottom casing component 11 and interiorly mounted control valve assembly 12; a combustion chamber such as an elongated first tubular member 13 (see FIGS. 2, 3 and 5); means for providing the transport of combustible gas from the source into the combustion chamber, such as a second tubular member 15 (see FIG. 5); and means for providing the transport of ambient air into the combustion chamber to mix with the combustible gas to effect combustion, such as the open second end 17 of tubular combustion chamber 13, and the volume thereof surrounding the second tubular member 15. The source of combustible gas preferably comprises a canister (e.g., six-ounce cannister) of liquefied butane 20 which is received by the control valve assembly 12, and provides a base for supporting the heater 10 in upright position. The heater 10 also includes a third tubular member 22 concentric with the combustion chamber 13, and an upper hollow casing component 23 surrounding the third tubular member 22.

Figure 5:
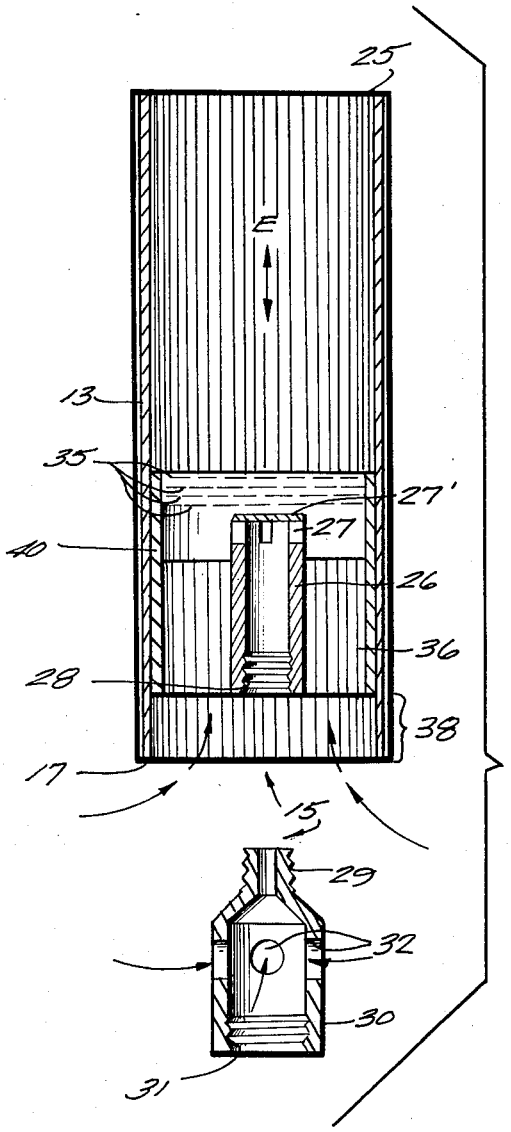
FIG. 5 is a cross-sectional view of an exemplary combustion chamber assembly utilizable in the heater of FIG. 1.

The preferred combustion chamber assembly associated with the heater 10 is illustrated most clearly in FIG. 5. The assembly includes the elongated tubular combustion chamber 13 which is preferably formed of a heat-resistant metal such as Kanthal, and includes a second, entry end 17, and a first, exhaust end 25 defining an exhaust conduit means in part. The second tubular member 15 preferably includes a first component portion 26 mounted completely within the combustion chamber 13 adjacent the second end 17 thereof, a metal disc 27 (e.g., Kanthal) closing off one end thereof (see FIG. 5). Slots 27' are formed in the end of portion 26 adjacent disc 27, the combustible gas mixture flowing horizontally through slots 27'. The end of the portion 26 opposite the disc 27 is preferably screw threaded at 28 to cooperate with screw threaded neck 29 of a second component 30 of the second tubular member 15. When the threaded portions 28, 29 engage, the second portion 30 extends outwardly from the second end of the combustion chamber 13. The bottom end of the portion 30 is threaded at 31 for cooperation with the control valve assembly 12 as will be hereinafter described. Means are provided defining a plurality of openings 32 and the second portion 30 to allow ambient air to flow thereinto and mix with combustible gas flowing from the control valve 12 to the combustion chamber 13.

A plurality of metal, heat-resistant screens (such as screens of Kanthal) 35 (e.g., four screens) are mounted within the combustion chamber 13 just above the slots 27' of first portion 26 of second tubular member 15. The screens 35 may be 18 mesh, and need not be catalyzed (e.g., coated with platinum) to perform their intended function. The screens 35 facilitate combustion within the combustion chamber 13 without flame (after initial ignition) and preferably are mounted so that the planes thereof are perpendicular to the direction of elongation E of the tubular combustion chamber 13.

Surrounding the second tubular member 15 within the combustion chamber 13 a honeycomb 36 (e.g., a stainless steel honeycomb) is provided. The honeycomb allows the flow of ambient air through the open second end 17 of the tubular combustion chamber 13 around the outside of the second tubular member first portion 26 and to the screens 35. This additional flow of air ensures that the combustion is not oxygen-starved, minimizing the production of pollutants. Preferably the honeycomb 36 terminates coextensively with the portion 26, terminating short of the second end 17 of the combustion chamber 13 so that a depending skirt or apron portion 38 is provided. The apron 38 acts to increase the chimney action through the screens 35 and ensures that all hydrocarbons pass upwardly through the hot zone at the screens 35, and are not bypassed around this hot zone.

Appropriate means are provided to mount the components within the combustion chamber 13 in the manner illustrated in FIG. 5. A common mounting means, such as sleeve 40, may be provided for the screens 35, second tubular member portion 26, and honeycomb 36. The outside diameter of the sleeve 40 is substantially the same as the inside diameter of the combustion chamber 13 so that a tight interference fit is provided therebetween. The honeycomb 36 is attached to the interior of the sleeve 40 and to the exterior of the portion 26. The screens 35 are attached in any suitable manner to the interior of the sleeve 40.

Figure 2:
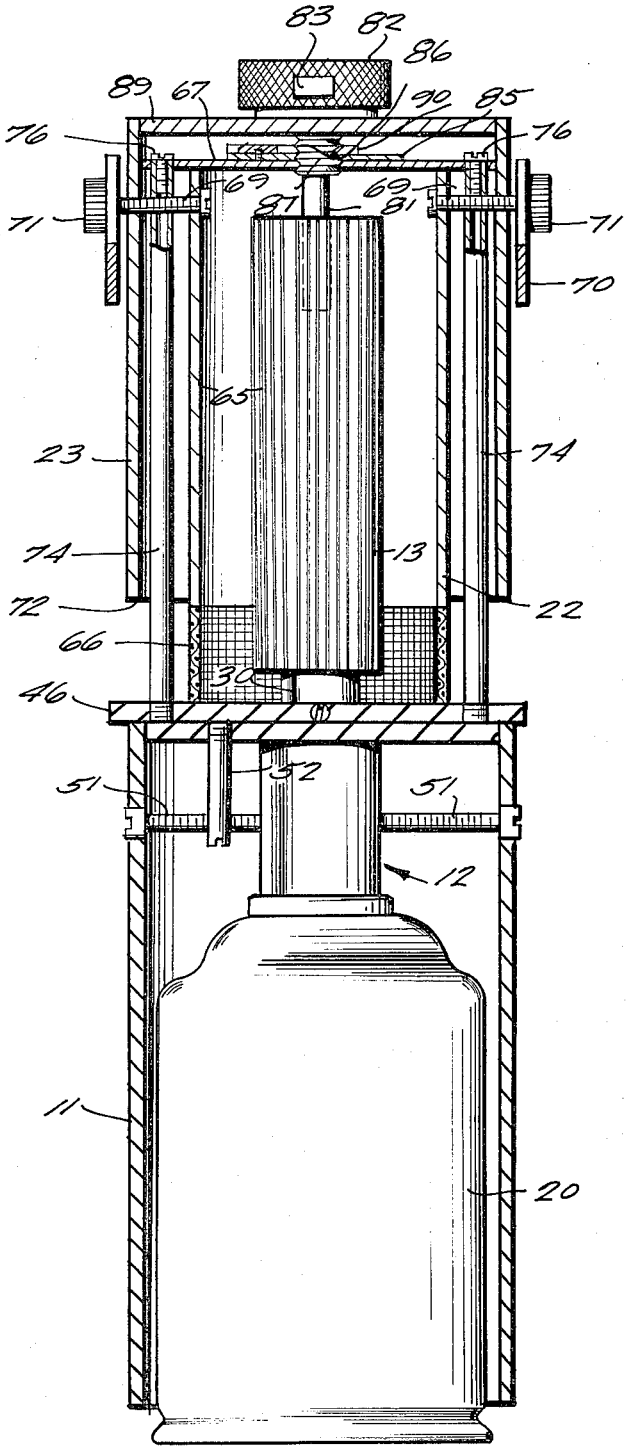
FIG. 2 is a side view of the heater of FIG. 1, partly in cross-section and partly in elevation.

The bottom portion 30 of the second tubular member 15 when operatively attached to the control valve means 12 mounts the combustion chamber 13 so that the second end 17 thereof is open to allow air flow therethrough, as seen most clearly in FIG. 2. The interior threads 31 of component 30 engage exterior threads 42 of a hollow tubular valve actuator 44. A fuel orifice structure 45, including a filter 45', is mounted to actuator 44 (see FIG. 4). The valve actuator 44 is held in engagement with plate 46 with locking screw 47 (see FIG. 4) so that rotation of plate 46 effects rotation of actuator 44.

Valve housing 49 is in screw threaded engagement with the bottom of the hollow tubular actuator 44 as indicated at 50 in FIG. 4. The housing 49 prevent relative linear movement between the bottom casing component 11 and the plate 46, however the plate 46 and bottom casing component are relatively rotatable with respect to each other. Mounting screws 51 rigidly attach the valve housing 49 to the casing component 11, and the valve stop 52 extends downwardly from plate 46 a sufficient distance to interfere with the screws 51 if rotated into contact therewith to define the limits of relative rotation between the valve actuator 44 and valve housing 49. The screw threads 50 transform relative rotation of the actuator 44 with respect to the valve housing 49 into linear movement of the actuator 44 in dimension E (see FIG. 4).

In addition to the actuator 44 and the housing 49, the control valve means 12 includes O-ring seal 54 surrounding the actuator 44 to prevent leakage between it and the housing 49; a disc 55 of flexible material and means defining a small opening 56 in the disc; a washer 57 of rigid material (e.g., metal); and a washer 58 of flexible material (e.g., neoprene). The disc 55 is preferably formed of neoprene or like material. The opening 56 formed therein is shown having an exaggerated size in FIG. 4 for clarity. In fact the size of opening 56 is extremely small, being made by a needle insertion. The washer 58 comprises a means for minimizing abrasive action as a result of relative movement between the actuator 44 and disc 55, and for facilitating a smooth tunable control of gas flow through the disc 55. The actuator 44 acts through the metal washer 57 and the neoprene washer 58 to effect compression of the disc 55 which then closes off the opening 56. When not acting through the washer 57, 58 to effect compression of disc 55, the actuator 44 allows the opening 56 to be opened and gas to flow from canister 20 through gas inlet tube 59 into and through the opening 56 and the washer 55.

As illustrated most clearly in FIG. 4, the canister 20 may be brought into screw-threaded engagement with the valve housing 49, as indicated at 60. When brought into tight threaded engagement, the gas inlet tube 49 punctures the seal on the top of the canister 20 allowing gas flow from canister 20 toward disc 55.

Figure 3:
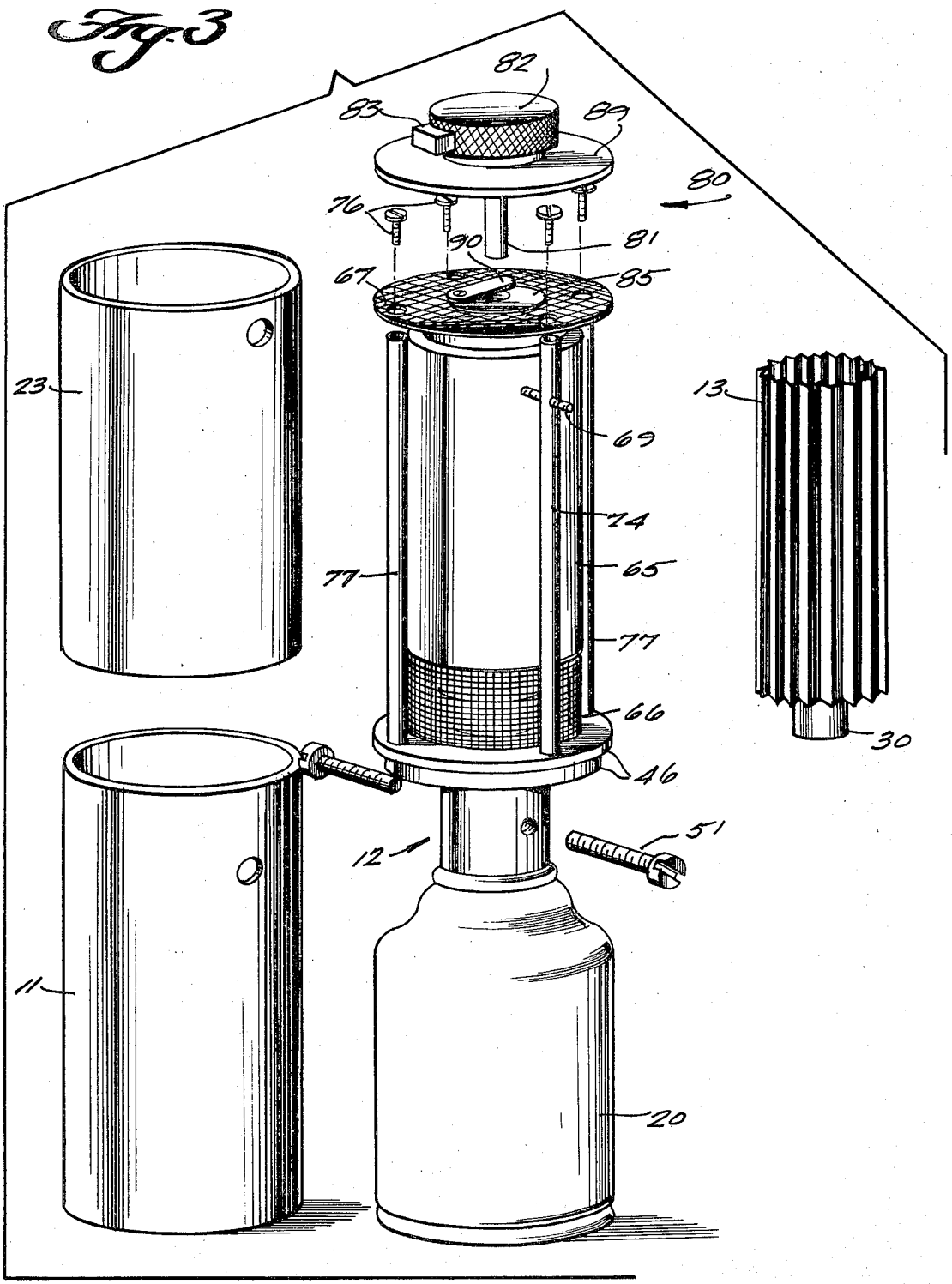
FIG. 3 is an exploded view of the heater of FIGS. 1 and 2.
Figure 1:
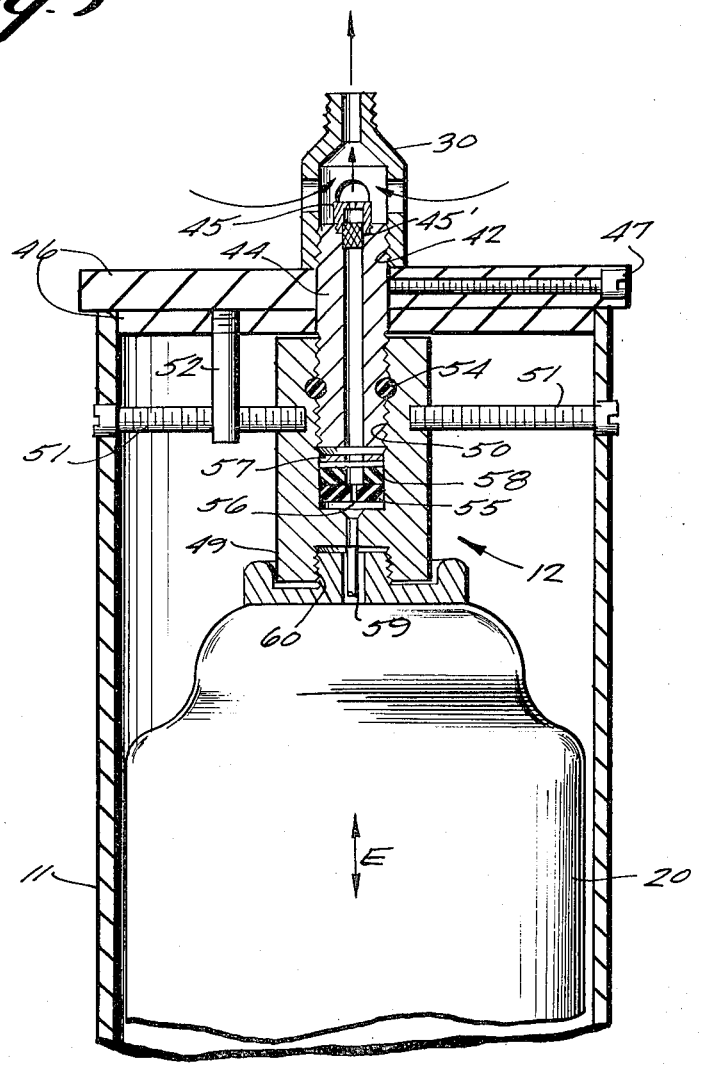

Surrounding the combustion chamber 13, and substantially concentric therewith, there is provided a chimney defined by a third tubular member 65. The member 65 is perforated at the bottom portion 66 thereof, as illustrated in FIGS. 1 through 3. The chimney 65 may be formed by a screen cylinder coated with a baked-on ceramic, such as Alseal 500, over the majority of the length thereof, except for the bottom portion 66 which retains the screen configuration. This construction allows the easy in-flow of air through the screen portion 66 and promotes a strong updraft or chimney effect as the air rises past the combustion chamber 13 between the exterior thereof and the interior of the tubular member 65. Some air flowing through section 66 also, of course, passes through combustion chamber open second end 17 through honeycomb 36, and through openings 32 in component 30. A screen 67 may be provided extending across the top of the chimney 65.

Surrounding the chimney 65 is the upper casing component 23. The upper casing component 23 is rigidly attached to the chimney 65 by screws 69 (see FIGS. 2 and 3 in particular) which screws 69 also provide for pivotal attachment of a handle 70 to the casing component 23, nuts 71 being provided exteriorly of the handle 70 for attachment to the screws 69. The casing component 23 bottom portion 72 terminates at about the same level as the perforated portion 66 of third tubular member 65 so as not restrict air flow into the chimney 65. The casing component 23 is attached to the plate 46 for rotation therewith by the rods 74 (see FIGS. 2 and 3). The screws 69 connect the chimney 65 and casing component 23, if desired, the screws 69 may pass through openings in the rods 74 (as illustrated in the drawings). The upper ends of the rods 74 pass through screens 67, and have screw threaded openings therein for receiving screws 76 (see FIG. 2). To further facilitate attachment between the components, a second plurality of threaded rods 77 may be provided connected (as by screws 76) between the plate 46 and the screens 67 (see FIG. 3).

In order to readily effect ignition of the gas when fed to the combustion chamber 13, it is preferable to provide a removable ignition device, such as the removable piezoelectric ignition device 80 illustrated most clearly in FIGS. 2 and 3. The actual ignition components of the device are known per se, and include an ignition wire mounted interiorly of a glass tube insulator in the downwardly extending aluminum tube 81 from a TDK Piezo unit mounted within upper casing 82. An actuator button 83 extends outwardly from the casing 82 and can be depressed to effect ignition. The tube 81 passes through a hot gas deflector plate 85 mounted in the central portion of the screen 67 and having internal threads 86 (see FIG. 3) for receiving the exterior thread 87 on the upper portion of the tube 81. A cover plate 89 also forms a part of the unit 80, and is dimensioned to cover the open top of the hollow upper casing component 23 (see FIGS. 1 and 2 in particular). If desired, a flat strip of metal 909 (see FIG. 3) is pivotally mounted to plate 85 for selectively covering or uncovering the central threaded opening 86 in plate 85. When 86 is uncovered a very hot gas flows therethrough; when 86 is covered by 90, the glass mixes with cooler air flowing upwardly through chimney 65.

Exemplary apparatus according to the present invention having been described, an exemplary manner of assembly and utilization thereof will now be set forth:

Assembly and Operation

The actuator 44 of the control valve means 12 is passed through the central opening in plate 46, and the second tubular member bottom component 30 is screw-threaded into engagement with the screws 42 on the actuator 44. The bottom casing component 11 is moved over the control valve means 12 so that the top thereof engages the plate 46 (see FIG. 4), and the screws 51 are passed through the lower casing component 11 to engage the valve housing 49 and rigidly hold the valve housing 49 in place with respect to the lower casing component 11.

The tubular combustion chamber 13, with screens 35, honeycomb 36, and the like mounted adjacent the second end 17 thereof, is passed over the component 30 and the threads 28, 29 are rotated into engagement with each other so that the combustion chamber 13 is supported with the second end 17 thereof spaced from the plate 46 (see FIG. 2). Then chimney 65 is disposed around combustion chamber 13 with the perforated portion 66 thereof adjacent the second end 17 of combustion chamber 13, rods 74, 77 are threaded into engagement with receiving openings in the plate 46, and screws 69 are passed from interiorly of the chimney 65 through openings in the chimney 65, casing upper component 23, and handle 70. Then nuts 71 are placed on the ends of bolts 69 to hold the components 65, 23, and 70 in fixed position with respect to each other (although pivotal movement of the handle with respect to the upper casing component 23 is allowed). The screen 67 is placed on top of the chimney 65 with the ends of the rods 74, 77 extending through openings in the screen 67, and screws 76 engaging threaded holes in the ends of the rods 74, 77 hold the screen 67 in place in that position. The tube 81 of the ignition unit 80 is then passed through the central threaded opening in plate 85 of screen 67, and threaded engagement is obtained between the threads 86, 87 until the cover plate 89 is in place on top of the upper casing component 23.

After assembly of the heater 10, it can be used as follows:

A canister 20 of butane gas is passed through the opened bottom of the bottom piece in component 11 so that threaded engagement is obtained between the top of the canister 20 and the interior threads 60 of the valve hosing 49, so that gas inlet tube 59 punctures the butane canister 20. To effect ignition, the casing components 11, 23 are grasped and relative rotational movement therebetween is effected to move them from a position wherein the arrows AB (see FIG. 1) on plate 46 and lower casing component 11 are in alignment, to a position wherein arrow B is in alignment with an indication line I of plate 46. Relative rotation between the housing components 11, 23 effects longitudinal movement in direction E of the hollow actuator 44 of control valve 12 to move from a position wherein it compresses the disc 55 and thereby closes the opening 56 therein, to a position wherein it relieves compression of disc 55 and allows flow of some gas from cannister 20 through tube 59 through the opening 56 in disc 55, through the hollow interior of actuator 44 and fuel orifice 45, into component 30. The relative position of the arrow B with respect to the indicator lines I determines the degree of compression of the disc 55, and therefore the amount of flow through the opening 56 in disc 55. Engagement of valve stop 52 with screws 51 prevents too much compression of the disc 55, or too much linear movement of the actuator 44 away from the disc 55.

Once the gas flow into component 30 has been established, the unit can be lit. Air flowing through perforated portion 66 of chimney 65 enters openings 32 of component 30 and flows upwardly with the combustible gas into combustion chamber 13, and likewise the air flows through honeycomb 36 towards screens 35. With the igniter 80 in the position illustrated in FIGS. 1 and 2, the actuator 83 is depressed, causing formation of a spark within combustion chamber 13. A slight noise indicates ignition of the gas. Once the noise is heard, the casing 82 is grasped and rotated to unthread the portions 86, 87, and the unit 80 (including plate 89) is removed from the top of the heater 10. At the start, a very pale blue flame may be visible on the surface of the screens 35, but as burning continues the screens 35 begin to glow. When equilibrium is reached, the screens 35 glow a bright orange and effect continuous combustion of combustible gas and air in combustion chamber 13 without any flame. Air flowing through perforated portion 66 of chimney 65 between chimney 65 and combustion chamber 13 provides an updraft, facilitating exit of heated air through the open top end 35 of combustion chamber 13, the draft of hot air being felt above the screen 67.

When operating, the heater 10 according to the present invention is noiseless and emits no visible light, is safe since there is no flame and no access to the interior of the combustion chamber, and is capable of providing heat for 8 to 10 hours from a single 6-ounce can of liquefied butane. Combustion is efficient and almost no pollution is emitted from the heater. Typical concentrations of common pollutants from the heater 10 are: hydrocarbons about 10 ppm or less; carbon monoxides about 1–2 ppm; nitrogen oxides about 0.1 ppm (all well below present EPA requirements).

It will thus be seen that according to the present invention a safe, simple, and efficient portable heater has been provided eminently suited for a multiplicity of uses. While the invention has been herein shown and described in what is presently conceived to be the most practical and preferred embodiment thererof, it will be apparent to those or ordinary skill in the art that many modifications may be made thereof within the scope of the invention, which scope is to be accorded the broadest interpretation of the appended claims so as to encompass all equivalent structures, methods, and apparatus.

What is claimed is:

1. A portable heater comprising a combustion chamber;

a hollow casing component having an interior cross-sectional area large enough to receive a canister of combustible gas therein;

control valve means mounted within said casing component for receiving a canister of combustible gas and valving the flow of combustible gas from said canister;

means for providing the transport of combustible gas from the canister through said control valve means into said combustion chamber;

means for providing the transport of ambient air into said combustion chamber to mix with said combustible gas to effect combustion; and said control valve means comprising: a disc of flexible material and means defining a small opening in said disc; a hollow tube actuator; a washer of rigid material disposed between said disc and said actuator; means for minimizing abrasive action as a result of relative movement between said actuator and said disc, and for facilitating a smooth tunable control of gas flow through said disc; and means for effecting movement of said actuator and rigid material washer to effect or relieve compression of said disc to close or open, respectively, the small opening in said disc to prevent or allow, respectively, combustible gas flow therethrough, said means for effecting movement of said actuator comprising means for effecting rotation of said actuator, and means for transforming rotary movement of said actuator into linear movement thereof toward and away from said disc.

2. A heater as recited in claim 1 wherein said means for minimizing abrasive action as a result of relative movement between said actuator and said disc, and for facilitating a smooth tunable control of gas flow through said disc, comprises a washer of flexible material disposed between said washer of rigid material and said disc.

3. A heater as recited in claim 2 wherein said disc and said washer of flexible material are neoprene, and wherein said washer or rigid material is metal.

4. A portable heater comprising means for receiving a source of combustible gas;

a combustion chamber comprising an elongated first tubular member;

means for providing the transport of combustible gas from the source into said combustion chamber;

means for providing the transport of ambient air into said combustion chamber to mix with said combustible gas to effect combustion;

means for facilitating combustion within said combustion chamber without flame comprising a plurality of screens disposed in the path of combustion gas and ambient air flowing into said combustion chamber;

exhaust conduit means leading from said combustion chamber to the ambient air to provide for exhausting of the products of combustion from said combustion chamber, comprising a first end portion of said first tubular member;

means for mounting said screens within said first tubular member adjacent a second end portion thereof; and wherein said means for providing the transport of combustible gas from the source to said combustion chamber comprises a second tubular member, substantially concentric with said first tubular member and completely in-line and positioned within said combustion chamber to inject combustible gas from said source onto said screens; means defining a plurality of openings in said second tubular member, completely within said combustion chamber, for the introduction of ambient air into a flow of combustible gas established in said second tubular member; said first tubular member second end portion surrounding said second tubular member; and means for mounting said first tubular member second end portion so that ambient air may flow thereinto.

5. A combustion chamber assembly for a portable heater, comprising:

an elongated tubular combustion chamber having a first exhaust end, and a second entry end;

a second tubular member mounted interiorly and substantially concentric with said tubular combustion chamber, and adjacent said second end thereof;

a plurality of screens;

means for mounting said screens within said combustion chamber in planes substantially perpendicular to the direction of elongation of said combustion chamber, and spaced from the interiormost end of said second tubular member;

a honeycomb structure surrounding a portion of said second tubular member within said combustion chamber adjacent the second end of said combustion chamber, said honeycomb structure allowing the passage of air through said combustion chamber second end around said second tubular member to said screens.

6. An assembly as recited in claim 5 wherein said second tubular member has a portion thereof extending outwardly from said combustion chamber second end past the termination of said combustion chamber second end.

7. An assembly as recited in claim 6 wherein said outwardly extending portion of said second tubular member includes means defining a plurality of openings in the walls thereof for the entry of surrounding air through the openings.

8. An assembly as recited in claim 6 or 7 wherein said outwardly extending second tubular member portion is coupled by screw threads with said second tubular member mounted within said combustion chamber.

9. An assembly as recited in claim 5 wherein said honeycomb structure terminates within said combustion chamber so that an apron is provided by a portion of said tubular combustion chamber past the termination of said honeycomb structure.

10. An assembly as recited in claims 5 or 9 wherein said honeycomb structure comprises a stainless steel honeycomb.

* * * * *